United States Patent [19]

Cook

[11] Patent Number: 4,605,391

[45] Date of Patent: Aug. 12, 1986

[54] APPARATUS FOR FLANGING CAN ENDS

[75] Inventor: Ronald Cook, Marquand, Mo.

[73] Assignee: Tools & Machinery Builders, Inc., Arcadia, Mo.

[21] Appl. No.: 716,839

[22] Filed: Mar. 28, 1985

[51] Int. Cl.[4] ..... B31B 1/13

[52] U.S. Cl. ..... 493/159

[58] Field of Search ..... 72/92, 93, 94; 493/158, 493/159

[56] References Cited

U.S. PATENT DOCUMENTS

| | | | |
|---|---|---|---|
| 2,277,128 | 3/1942 | Miller | 493/158 |
| 2,686,551 | 8/1954 | Laxo | 72/93 |
| 3,531,967 | 10/1970 | Werge | 72/94 |
| 3,668,981 | 6/1972 | Turpin et al. | 493/64 |
| 4,402,202 | 9/1983 | Gombas | 72/94 |

*Primary Examiner*—Lowell A. Larson

[57] ABSTRACT

An apparatus for flanging the upper and lower ends of a continuous stream of fiberboard cans includes a central rotating turret with a pair of flanges which rotate with the turret and are oriented to grasp each can in its top and bottom opening and press it against a pair of stationary curvilinear rails to spin the can as the rails flange the upper and lower ends of the can. An inlet turret and outlet turret sequentially space the cans and feed them into the rotating turret and flanges.

21 Claims, 6 Drawing Figures

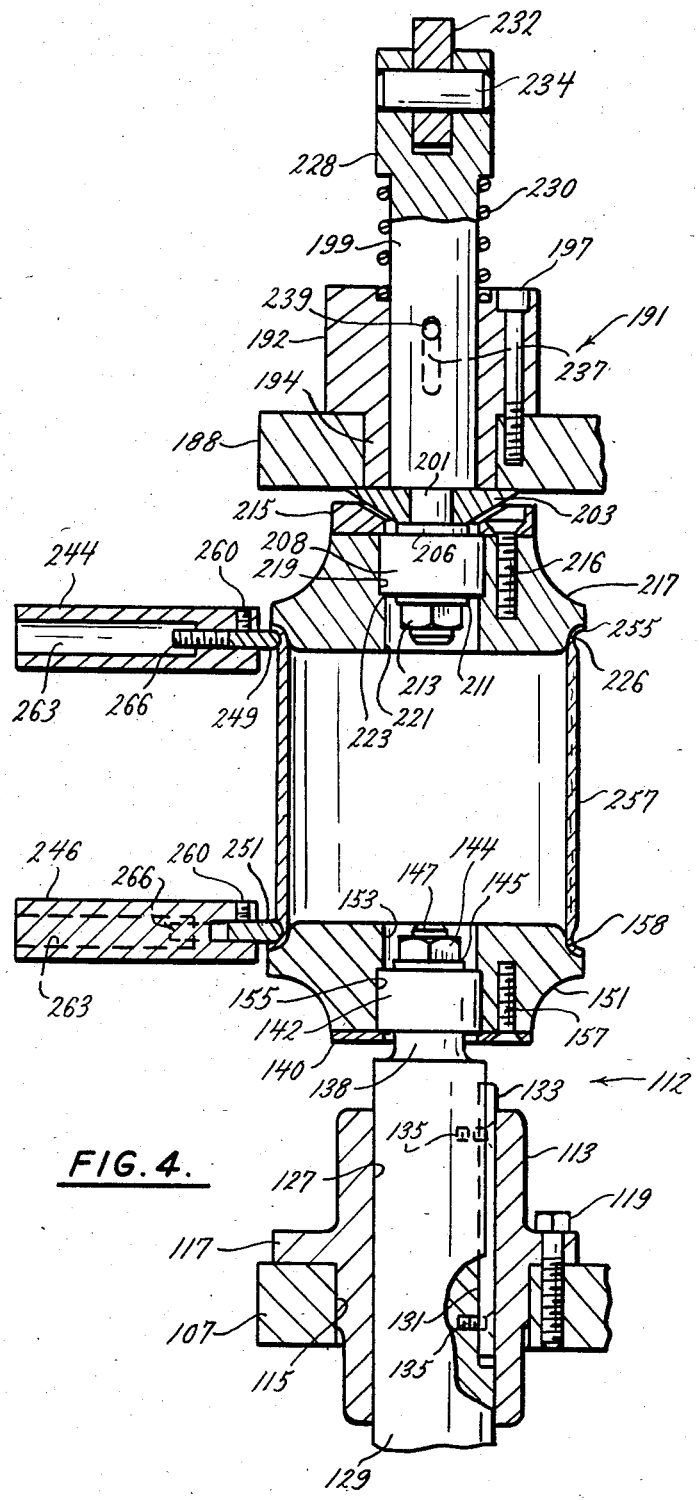
FIG. 4.
FIG. 5.
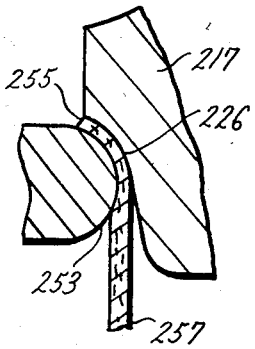
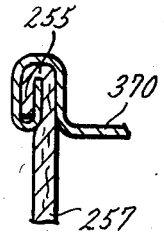
FIG. 6.

APPARATUS FOR FLANGING CAN ENDS

BACKGROUND AND SUMMARY OF INVENTION

The present invention relates to the flanging of the ends of fiberboard cans, and more specifically to flanging the ends by mounting the cans to be flanged upon rotatably mounted flange heads which act like a chuck to grip the can and to move the can against a stationary compression rail which presses the ends of the cans against the flange heads to compress the ends.

The inventor is aware of patents describing machines of the prior art which are generally related to the area of flanging can ends. These patent references include Escallon et al. U.S. Pat. No. 4,341,103 which discloses an apparatus for flanging an end of a can wherein the can is rotated between an inner and outer mandrel, and the inner and outer mandrels are moved progressively radially outward and inward, the can being formed by the compression between the two mandrels. The apparatus takes between two to ten revolutions to flange the end of a metal can. Morrell U.S. Pat. No. 2,367,419 discloses a fiberboard can with an annular slot at each end to secure a metal collar therein, the collar providing means to secure top and bottom closures. Morrell does not disclose or suggest any flanging of the fiberboard can. Vanderslice U.S. Pat. No. 1,606,677 discloses an apparatus for flanging heavy metal heads for boilers and the like. The flanging is achieved by placing the end between a pair of nip rollers and rotating the piece between them, the flange being formed by compression between the nip rollers. Abner U.S. Pat. No. 4,369,912 discloses merely a composite can having flanged ends for securing metal ends thereto by means of conventional crimping or the like. The flange is shown as being J shaped for maximum strength and use with a conventional can opener. Schuchard U.S. Pat. No. 3,487,665 discloses a simple fixture for straightening an already formed flange which may have been damaged by handling or the like. It includes a roller for rolling along the flange as a die member is rotated to rotate the can beneath the roller and the die. Marcovitch U.S. Pat. No. 3,533,259 discloses a machine and method for the profiling of forge castings or the like under heavy pressure and with roller forming means. Carpenter U.S. Pat. No. 2,892,749 discloses a method and apparatus for forming a flange on fiberboard shells by squeezing the shell between two dies, the internal die being expanded and contracted against the outer die to compress the shell into the desired shape. Rychiger U.S. Pat. No. 3,212,468 discloses an apparatus for sealing containers by collapsing a mating rim flange between the two container halves with a pair of dies, the dies being brought together to collapse the rims in a pre-determined manner. Van Alsburg U.S. Pat. No. 4,389,147 discloses an apparatus for creating a chime-like bead in a can sealed at one end by inserting a mandrel into the can and holding it in place with a back-up rail, the mandrel being rotatably mounted and having ribs and a ring of the desired shape of the can sidewall, and then rolling the can between the mandrel and a fixed beading rail, the fixed beading rail having recesses to match the shape of the mandrel and thereby form the chime-like bead between the mandrel and the beading rail.

Of the devices described in these prior art patents, none of them disclose or suggest a method or apparatus for flanging both ends of a can at the same time. Nor do they disclose or suggest an apparatus which has a pair of opposing freely rotatable flange heads with each flange head having a rim to fit within the interior of the can and near the sidewall so that the flange heads capture the can therebetween with the rim also being the surface against which the sidewall is compressed to form the flange. Still another feature not found in the prior art is a means for sequentially feeding cans into and removing cans from the flange heads to ensure a continuous and smooth flanging process. Still other features of the present invention are neither disclosed nor suggested by this prior art, as more fully explained, infra.

The present invention has features not suggested or taught by the prior art. The flanging machine of the invention in a preferred embodiment comprises a plurality of upper and lower flange heads for gripping fiberboard cans, the flange heads being attached to rods mounted for vertical sliding movement on respective discs. The upper and lower flange heads are equidistantly spaced about their supporting discs, and are aligned with each other in pairs. The discs are affixed to a spindle which rotatably drives the disc and flange heads. Means is provided to move the lower flange heads up and down, comprising in the preferred embodiment a cam ring having a groove which is located about the spindle, with the bottom of the flange head mount rods having a cam follower fitted within the groove so that as the spindle rotates the cam follower moves the lower flange head up or down to carry out the necessary steps for operation.

In a preferred embodiment, the upper flange head rods slide in tubes mounted to the disc, with means to limit the vertical movement of the upper flange head such as a stop pin mounted to the support rod and bearing against the ends of a notch in the tube.

The upper flange heads each have biasing means, such as a spring, mounted against the rod and the support tube, to bias the flange head in an up position, with means for receiving a depressing force against the rod such as a cam follower mounted atop the rod. A separate cam plate is mounted above the said cam follower at a certain location relative to the spindle, so that when the cam follower engages the cam plate, the cam follower and the upper flange head to which it is connected are moved downward.

Both the upper and lower flange heads are rotatably mounted to their supporting discs to spin about a vertical axis, and in a preferred embodiment the flange heads spin relative to their support rods such as by a roller bearing. The support discs for the flange heads can be adjusted to be attached at different positions on the spindle to accommodate different size cans.

Located to the outside of the flange heads are horizontal compression rails which in the preferred embodiment are of arcuate shape and are adjustably mounted, as by adjustment screws, for change in horizontal position within slots of tracks. The compression rails are spaced from one another so that the lower rail is aligned to contact the lower edge of a fiberboard can placed on a lower flange head, while the upper rail is aligned to engage the upper edge of a fiberboard can mounted to the top flange head. The flange heads in a preferred embodiment have a curvedly tapered outer rim surface which fit against the inside ends of the cans so that the compression rail which in a preferred embodiment is rounded, presses the can ends against the tapered portion of the flange heads to form compressed flange ends.

The tracks and compression rails are adjustably mounted so that they can be vertically moved to different levels to fit cans of different sizes.

The invention further comprises an engagement bar which in the preferred embodiment is of arcuate shape and has a resilient inner surface which acts to engage one side of a can as it is rotated about the spindle, while the other side of the can is held against a pocket of a turret mounted about the spindle to prevent the can from falling off the lower flange head when the upper flange head is removed from contact with a can, and to also hold the can at the same position when the lower flange head is moved out of engagement with the can when the can is moved about the spindle towards a discharge turret.

An inlet turret and a discharge turret act with a conveyor so that a can coming in on the conveyor is contacted by a cog in the inlet turret to fit within a recess thereof and be supported by a lower turret plate and move along a guide rail extending across the conveyor so that the can is moved towards a lower and upper flange head. As the can is so positioned the lower flange head is moved upwardly by camming action to seat against the lower end of the can and to move the can so that its upper end engages the upper flange head.

After the two flange heads grip the ends of the can in a chuck-like grip, the can is moved to gradually come into contact with the compression rail and when full compression of the rail upon the can ends against the flange heads begins, both flange heads spin or rotate about their mounts and continue to do so until a 360° rotation of the can is made. At this point movement against the compression rail is terminated and the flange heads continue to move the cam with both flange heads then being moved in a downward direction such as by camming action upon both flanges, and then the upper flange head is suddenly snapped upwardly away from the can, such as by release of the cam follower with the upper cam and exertion of upward spring bias, to disengage the upper flange head from the can. The can continues to be moved, with the turret pocket and engagement bar surface contacting opposite sides of the can to keep it from wobbling off the lower flange. Movement of the can towards a discharge turret continues and, as the can approaches the turret, the lower flange head is moved slightly downwardly by the lower cam action while the turret pocket and engagement surface hold the can at the same level, so that the bottom of the can is moved underneath a support plate on the outlet turret and the can moves into a turret recess. The turret moves the can towards the conveyor belt where the can is further guided by the conveyor outlet guide rail onto the belt to be sent to another location.

The flange formed by the machine of the invention can then be further shaped to bend back upon itself to form a J configuration which can overlap against the end of a fiberboard can, which can be of metal.

By having the flanging process take place at both ends simultaneously, steps are saved in the flanging process, and it is unnecessary to dismount a can after one end is flanged and remount it to flange the other end. The spinning chucks allow for ease in the flanging operation and because their rotation is brought about by the frictional engagement of the compression rails against the can ends and against the tapered portion of the flange heads, the rotation of the flange heads and the movement of the can ends against the compression rail is at a rate which prevents tearing or mutilation of the can ends.

The horizontal and vertical adjustability of the compression rails, and of the flange head support discs heights, allows ease of changing settings for different can sizes.

When a selection of a setting for the various components is made, the invention allows a plurality of cans of the same size to be continually fed into the machine and flanged at both ends then discharged so that a quick, continuous, and efficient flanging operation takes place.

DESCRIPTION OF THE DRAWINGS

FIG. 4 is a section taken on the line 4—4 of FIG. 1, with the horizontal adjustment screw for the lower compression rail being shown withdrawn from the slot housing the compression rail;

FIG. 5 is an enlarged view showing the upper compression rail pressing the end of a fiberboard can against the tapered curved surface of the upper flange head; and FIG. 6 shows the flanged can with its end bent over itself and in contact with an end of a can.

DESCRIPTION OF THE PREFERRED EMBODIMENT

Figure 2:
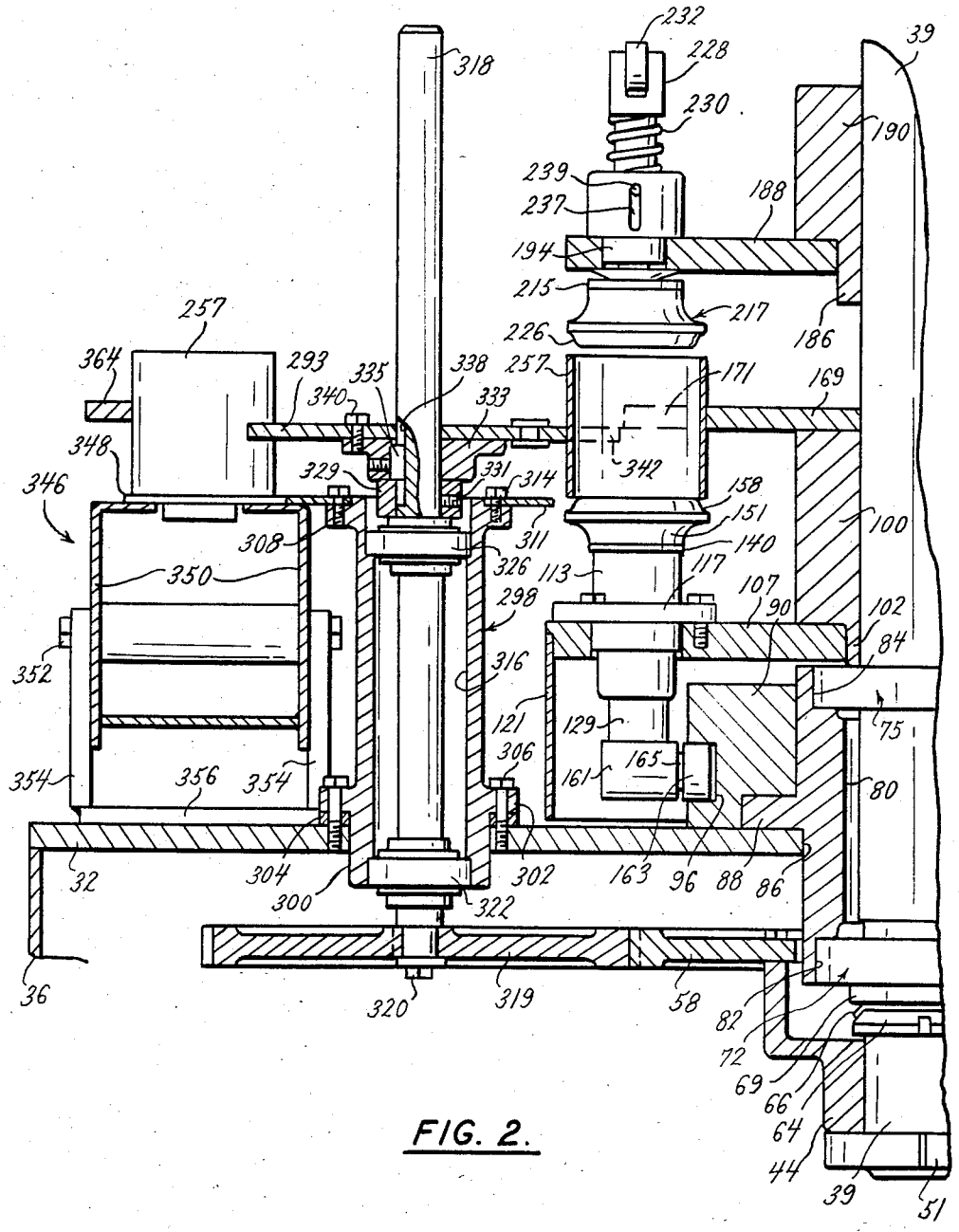
FIG. 2 is a section taken on the line 2—2 of FIG. 1, said line 2—2 extending from the center of the spindle towards the center of a shaft for the inlet turret and then angling to extend perpendicular to the conveyor belt.

As seen in the drawings, the flanging machine 30 comprises a floor plate 32 having at its corners base mount plates 34, and being supported above the floor of a building by depending walls such as shown as 36 in FIG. 2. In the approximate center of machine 30 is a spindle 39, the lower end of which is mounted (FIGS. 3 and 2) to an inverted stepped collar 42 which has a lower neck 44 having a primarily cylindrical bore which receives the lower end of spindle 39. The lower end of spindle 39 has a flattened recess which receives a drive key plate 47 which is also within the bore of neck 44 and is held against the spindle by a set screw 49 threaded through neck 44. A split collar 51 is held by screws 53 tightly around the lower end of spindle 39 to prevent downward movement of collar 42 relative thereto.

The collar neck 44 extends upwardly into a broader cylindrical head 56 having its upper edge secured to a spur gear 58 by screws 60 passing through bores in the wall of gear 58 into threaded bores in head 56 so that rotation of gear 58 acts through the collar 42 and key 47 to rotate spindle 39.

Within the bore 62 of head 56 is a threaded lock ring 64 which mates with a threaded section of spindle 39 and which supports spacer plates 66 and 69 which are standard for mounting a roller bearing 72 thereabove, with spindle 39 being telescopically press fit within the inner race of bearing 72. Spaced above bearing 72 is a second roller bearing 75 having an inner race which telescopically receives spindle 39.

Positioned about the spindle 39 between bearings 72 and 75 is a mount sleeve 78 having a cylindrical bore 80 spaced from spindle 39. Sleeve 78 has at its lower end an enlarged bore 82 which telescopically receives by press fit the outer race of bearing 72, and has at its upper end a circular bore 84 which likewise receives the outer race of bearing 75. Sleeve 78 extends through a circular bore 86 in floor 32, and sleeve 78 has an intermediate annular flange 88 whose lower side fits flush against the top of floor 32.

A ring cam 90 has a central bore which telescopically receives the upper part of sleeve 78 and has a lower annular recess which telescopically receives sleeve flange 88. Screws 94 extend (FIG. 3) through vertical bores in cam 90, flange 88 and floor 32 to secure cam 90 and sleeve 78 to floor 32 to be stationary relative to spindle 39.

The ring cam 90 has an exterior groove 96 which extends to rise and fall about the circumference of cam 90 to receive a cam follower to be described.

Above the second roller bearing 75 a disc mounting sleeve 100 has a lower smaller cylindrical end 102 (FIG. 2) whose lower edge rests upon the inner race of roller bearing 75. Sleeve 100 has a bore telescopically receiving spindle 39, with a lock pin 104 passing through horizontal semi-circular mating bores in sleeve 100 and spindle 39 to hold sleeve 100 in fixed position relative to spindle 39 to rotate therewith.

A first mounting disc 107 is attached to sleeve 100 by screws 110 (FIG. 3) passing through the disc to be received in threaded vertical bores in sleeve 100.

Eight flange head mount assemblies 112 are mounted equidistantly about disc 107. As shown more specifically in FIG. 4, each assembly 112 comprises a mount tube 113 which fits telescopically in vertical holes 115 in disc 107, each mount 113 has an annular flange 117 whose lower surface rests flush against the upper surface of disc 107, with bolts 119 extending through bores in flange 117 and disc 107 to secure the two together.

Figure 3:
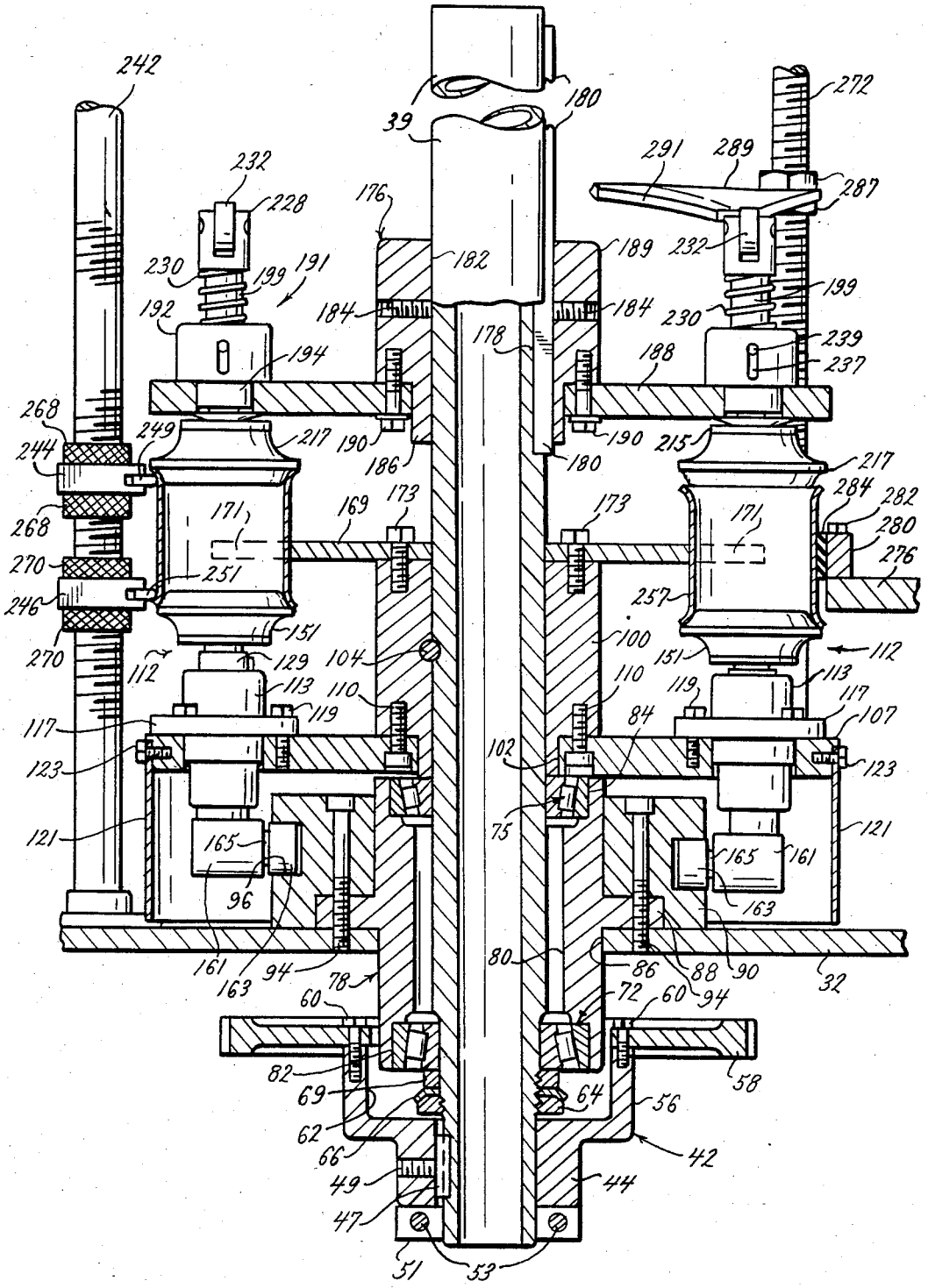
FIG. 3 is a section taken on the line 3—3 of FIG. 1.

As shown in FIG. 3, the outer edge of disc 107 has a depending protective skirt 121 mounted within a conforming exterior groove in the disc outer edge by bolts 123 to be secured thereto.

Mount tube 113 has a primarily cylindrical bore 127 which receives a primarily cylindrical flange mount rod 128, which has a flat chordal side 131 with a key 133 held thereagainst by a pair of screws 135 passing through key 133 into threaded bores in rod 129, with the exterior of key 133 resting against a conforming shape of tube bore 127 so that rod 129 is held against rotation within tube 113 but is slidably mounted for vertical movement therein.

Rod 129 extends upwardly into a reduced section 138 which extends through, and is spaced from, a bore in a lock ring 140, and thence extends through the inner race of a roller bearing 142 and thence is reduced in size and passes through the bore of a washer 145, and finally terminates in a threaded end 147 screwed to nut 144 which rests flush against washer 145.

Mounted atop rod 129 is a flange head 151 having an upper cylindrical bore 153 which houses nut 144 and washer 145, and which extends into a shoulder and thence into a larger lower bore 155 which telescopically receives the outer race of bearing 142, with the upper surface of lock ring 140 fitting flush against the lower surface of flange head 151 and being secured thereto by screws such as 157 passing through ring 140 into flange head 151 so that the top of the inner edge of ring 140 presses against the bottom of the outer race of bearing 142, and the flange head shoulder 156 presses against the top of the outer race of bearing 142 to sandwich bearing 142 therebetween so that flange head 151 moves vertically with rod 129. Each flange head 151 has a curvedly tapered upper outer surface 158 designed to mate with a compression rail to be described.

As seen in FIGS. 2 and 3, the lower end of rod 129 extends into a foot 161 having a conventional means for mounting a rotating cam follower wheel 163 which is rotatably mounted by an axle 165 to foot 161. Cam follower 163 is received within groove 96 of ring cam 90 to roll therein and rise and fall with groove 96 so that as the disc 107 is rotated by spindle 39, cam follower 163 acts to raise and lower rod 129 and the flange head 151 at certain locations.

Returning back to spindle 39, at the upper end of sleeve 100 is a turret place 169 (FIGS. 2 and 3) having eight curved pockets 171 each shaped to receive the exterior of a fiberboard can. Turret 169 has a cylindrical central bore which telescopically receives spindle 39, with bolts 173 (FIG. 3) passing through turret 169 into threaded bores in sleeve 100 to firmly affix turret 169 to rotate with spindle 39.

Above turret 169 is a second disc mounting sleeve 176 having a primarily cylindrical bore which receives spindle 39, with the spindle 39 having a recessed flattened chordal section 178 which receives a key 180 which fits within a conforming shape of central bore 182 of sleeve 176. Sleeve 176 is held against vertical movement relative to spindle 39 as by horizontal screws 184 which extend through sleeve 176 to press or lock against spindle 39 or key 180.

The lower section 186 of sleeve 176 is reduced and is telescopically received within a central bore of a second mount disc 188, with sleeve section 186 extending upwardly into a larger section 189 whose lower edge fits flush against the upper surface of disc 188, with bolts 190 (FIG. 3) passing through vertical bores in disc 188 into vertical threaded bores in sleeve 176 to secure disc 188 to sleeve 176 to rotate with spindle 39.

Disc 188 has eight equidistantly spaced flange head mount assemblies 191 each having the same structure. Each assembly 191 comprises a tube 192, which, as seen more clearly in FIG. 4, has a lower reduced section 194 which telescopes within a hole in disc 188. Screws 197 extend through vertical bores in tube 192 into bores in disc 188 to secure tube 192 thereto. Tube 192 has a central bore which slidingly receives flange head mount rod 199.

From mount tube 192, rod 199 extends downwardly into a reduced cylindrical section 201 which passes through a bore of a conical spacer 203 whose larger upper surface rests against the lower surfaces of disc 188 and tube section 194, and whose lower end rests against the top of a spacer ring 206. Rod section 201 passes through a bore in spacer 206 thence through the inner race of a roller bearing 208 thence through a bore in washer 211 and terminates into a threaded end to which nut 213 is attached.

A lock ring 215 has a tapered bore angled to mate against spacer 203, and has its lower inner edge resting against the outer race of bearing 208, so that a flange head 217 can have its upper surface flush against the lower surface of ring 215 with screws 216 passing through ring 215 into flange head 217 to secure the two together. Flange head 217 has an upper central bore 219 which receives as by press fit the outer race of bearing 208, and which extends downwardly into a smaller cylindrical bore 221 with a shoulder 223 formed therebetween to support the outer race of bearing 208, so that flange head 217 and ring 215 sandwich bearing 208 to move vertically with rod 199. Flange head 217, like head 151, has a curvedly tapered outer rim 226, shown enlarged in FIG. 5.

It can thus be seen that both flange heads 151 and 217 are attached to rotate or spin relative to their respective mount rods 129 and 199.

Mount rod 199 has an enlarged upper cylindrical section 228 with a lower edge that abuts the top of a spiral spring 230 which extends about rod 199. The lower end of spring 230 is held within an annular groove in the upper end of tube 192.

Rod end 228 has a vertical slot which houses a cam follower wheel 232, with an intersecting horizontal bore telescopically mounting an axle 234 for wheel 232. Mount tube 192 has a vertical notch 237 extending through its side. A stop pin 239 is horizontally mounted within a hole in rod 199 and passes into notch 237 to limit the vertical movement of rod 199 relative to tube 192 by contacting the ends of notch 237.

Securely mounted by conventional means to floor 32 at a position exterior to the flange heads 217 and 151 are a pair of vertical threaded columns 242, which pass through bores in upper and lower arcuate compression tracks 244 and 246, each of which has an arcuate slot along its inner edge which receives a compression rail 249 or 251 respectively. Each rail 249 and 251 has an exterior rounded end 253, as seen more clearly in FIG. 5, projecting outwardly from the interior side of the tracks 244 and 246 to mate against the curved flange head surfaces 226 and 158 to compress the end 255 of a fiberboard can 257 therebetween.

As seen most clearly in FIG. 4, set screws 260 pass through vertical bores in tracks 244 and 246 to press against the top of rails 249 and 251 to hold them in fixed position relative to tracks 244 and 246. Tracks 244 and 246 have a plurality of larger horizontal bores 263 which extend from the exterior of the tracks 244 and 246 in a radial direction to open into smaller threaded radial bores which receive adjustment screws 266. The position of the rails 249 and 251 on tracks 244 and 246 can be adjusted by releasing the pressure of set screws 260 and inserting a wrench or screwdriver into bores 263 to turn adjustment screws 266 to change their position by either the screws 266 pushing the rails 249 and 251 out farther from tracks 244 and 246, or by the screws 266 being moved away from rails 249 and 251 so that rails 249 and 251 can be pushed farther into their housing slots in tracks 244 and 246. After such repositioning, the set screws 260 can be again screwed down to hold rails 249 and 251 in fixed position.

As seen more clearly in FIG. 3, each rail 244 and 246 is secured to columns 242 by pairs of knurled nuts 268 or 270 to hold the tracks 244 and 246 in fixed position on columns 242, but to allow adjustment of the track heights by movement of the nuts 268 and 270 along columns 242.

Mounted to the right of spindle 39 (from the viewpoint of FIGS. 1 and 3), are a pair of threaded columns 272 and 274 which are firmly attached to the floor 32 by conventional means, such as a nut, not shown. An arcuate engaging track 276 has bores which receive columns 272 and 274, and is held firmly to columns 272 and 274 by nuts such as 278 located above and below track 276 to sandwich track 276 therebetween, but to allow adjustment of the height of track 276 by raising or lowering of the nuts 278. Along the upper inner edge of track 276 is an arcuate engagement bar 280 which is secured to track 276 by vertical bolts 282 passing through bar 280 and into track 276. The interior vertical wall of bar 280 curves to be flush with that of track 276, and has a rubber engagement strip 284 affixed thereto as by adhesive for engaging the outer surface of a can 257 in a fashion shown in FIG. 3 which engagement acts with the turret pocket 171 on the opposite side of can 257 therefrom to grip the can 257.

Well above track 276 on column 272 are a pair of nuts 287 which act to sandwich the outer end of a cam plate 289 therebetween to hold it in fixed position on column 272. As shown in FIG. 3, the inner band 291 of cam 289 is of arcuate shape and inclines downwardly in a clockwise direction, so that as a rod 199 revolves about spindle 39 beneath cam 289 the cam follower 232 at the top of rod 199 engages the cam band 291 when the rod 199 is at its upwardly extended position and pushes rod 199 downward by overcoming the resistance bias spring 230. After a rod 199 passes beyond cam 289, spring 230 snaps rod 199 up to its extended position.

Figure 1:
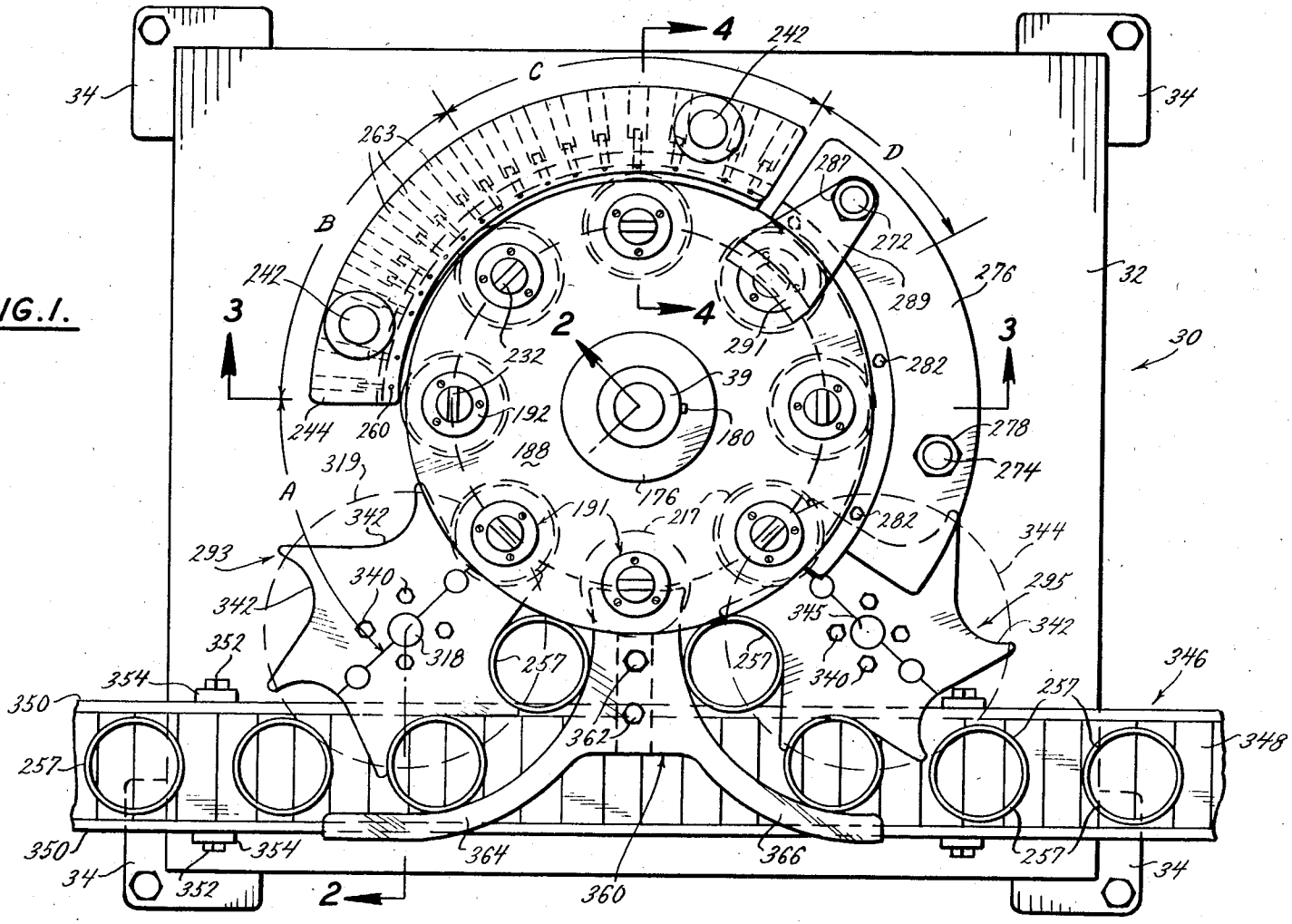
FIG. 1 is a plan view of the flanging machine with arrows being designated to show certain segments of arcuate movement of the flange heads about a central spindle.

Focusing now on FIGS. 1 and 2, machine 30 has an in-feed turret 293 and a discharge turret 295 for moving cans into and away from engagement with the flange heads 151 and 217. Description of the mounting of turret 293 is sufficient to describe that of turret 295. Referring to FIG. 2, a vertical tube 298 has an enlarged cylindrical lower section 300 which is telescopically received within a cylindrical bore in floor 32, with tube 298 having an annular flange 302 flush against the underside of flange 302 and flush against the upper side of floor 32, so that screws 206 extend through flange 302 into floor 32 to hold tube 298 firmly to floor 32. Tube 298 extends upwardly into an upper annular flange 308 which has an upper annular notch along its top side that receives the inner rim of a can support plate 311 which extends completely about tube 298. Bolts 314 extend through plate 311 into threaded aligned bores in flange 308 to secure plate 311 thereto.

Extending through and spaced apart from the central bore 316 of tube 298 is a turret shaft 318 which at its lower end is reduced in size and secured to a spur gear 319 by conventional means such as by a nut 320. Shaft 318 extends upwardly therefrom to pass through the inner race of a roller bearing 322 supported and mounted to shaft 318 by conventional means in fixed position on shaft 318, with the outer race of bearing 322 telescopically received within an interior annular spindle notch at the bottom of tube 298 in the fashion described for spindle roller bearing 72. Shaft 318 extends upwardly through the inner race of an upper ball bearing 326 held in fixed position on shaft 318 by the same conventional means as bearing 322, the outer race of bearing 326 telescopically received within an enlarged bore at the upper end of tube 298 to be supported on the shoulder thereof such as spindle bearing 75 is supported. Above bearing 326 is a collar 329 through which shaft 318 extends, which is held to shaft 318 such as by a set screw 331. On the upper side of collar 329 rests the lower side of an inverted hat shaped turret mount 333 which is attached to rotate with shaft 318 by a key 335 which fits within the bore of mount 333 against a flattened recess 338 in shaft 318 and a set screw bearing against key 335. The lower surface of turret 293 fits flush against the top of mount 333 with bolts 340 passing through turret 293 into threaded bores in mount 333 to secure turret 293 thereto to rotate with shaft 318. Turret 293 has a plurality of arcuate recesses 342 forming cogs, which recesses 342 are shaped to receive and rotate cans 257. The lower gear 344 of turret 295 corresponds to gear 319 and is mounted to the bottom of the shaft 345 of turret 295 in similar fashion. A motor (not shown) drives gear 344 which meshes with spindle gear 58 to rotate spindle 39, with gear 58 meshing with gear 319 to drive turret 293.

A conventional conveyor belt assembly 346 is positioned next to turrets 293 and 295. Conveyor assembly 346 has a typical conveyor belt 348 upon which a plurality of cans 257 can be longitudinally placed, the belt 348 riding atop horizontal flanges of angles 350, which are supported by a bolt 352 on rods 354 that are firmly attached as by welding to a plate 356 which in turn is firmly secured to floor 32 by conventional means such as welding or bolts.

The conveyor assembly 346 has a V shaped guide rail arrangement 360 secured by bolts 362 to support structure attached to the floor 32 to be firmly attached to floor 32 and elevated above conveyor belt 348. Arrangement 360 has a curved inlet guide rail 364 which receives incoming cans 257 and an opposite outlet guide rail 366 which receives cans 257 which have been flanged to guide them onto conveyor belt 348.

OPERATION

In operation, a plurality of cans 257 are spaced equidistantly from each other on conveyor belt 348 by a conventional spacing means such as a timing screw, not shown, so that one by one the cans 257 are moved into position on contact inlet guide rail 364 and be engaged within a recess 342 of inlet turret 293 with turret plate 311 supporting the bottom of each can 257. Turret 293 moves the can 257 counterclockwise as shown in FIG. 1 so that the can 257 is moved within a pocket 171 of turret 169 which acts to guide the rotational movement of can 257 about spindle 39. The movement of turret 293 and turret 169 moves the can 257 to the position shown in FIG. 2 to be directly above lower flange head 151 and directly below upper flange head 217. For the next 45° of arcuate movement about spindle 39, said arc designated by arrows as A in FIG. 1, the lower flange head 151 is moved upwardly to seat against the lower end of can 257 by virtue of the cam follower 163 being moved upwardly within an inclining portion of the cam groove 96 to thus move rod 129 and flange head 151 upwardly. This raising of flange head 151 raises the upper end of can 257 to engage the top flange 217 to thus move can 257 to the position shown in FIG. 3.

At the position of FIG. 3, the second arcuate transition area designated B by the arrows in FIG. 1, begins, and at this point it can be seen that flange head 151 and flange head 217 both are fitted against the ends of can 257 to grip it as a chuck, with the tapered flange head edges 158 and 226 pushing out against the inside of the ends 255 of can 257. When the two heads are brought together in the area A, a preliminary flange is formed on the can blank. See the left side of FIG. 3.

As the spindle is rotated through arc B, the flange heads 151 and 217 remain at the same level. The compression rails 249 and 251 are positioned on their tracks 244 and 246 respectively, so that when the can 257 is at the beginning of arc B, the rails 249 and 251 are spaced just barely in contact with the can ends 255, and as movement through arc B continues the rails 249 and 251 are positioned to gradually move closer to the flange heads 151 and 217 to gradually begin moving against the can ends 255.

The clockwise rotation of the spindle 39 continues until the designated can 257 reaches the beginning point of the arc designated by arrows as C in FIG. 1, at which point the rail ends 253 are pressed fully into the can ends 255 to compress them to a desired degree as depicted in FIG. 5, such as a 40% compression. As depicted in FIG. 4, the can 257 is shown at a point within arc C, with the can ends 255 being compressed. During movement through arc C the flange heads 151 and 217 remain at the same level. As can 257 is moved through arc C the flanges around the can ends are fully formed, with the friction of the compression rail ends 253 against the can ends 255 and thereby against flange head surfaces 158 and 226 causing the flanges 151 and 217 to both spin or rotate about their mounting rods 129 and 199, respectively, so that the can 257 rotates a full 360° as it moves through arc C to fully compress the can ends 255.

Spindle 39 continues to rotate to move can 257 to the end point of arc C at which point the compression rails 249 and 251 and their corresponding tracks 244 and 246 terminate, the hence compression of the can ends 255 ceases.

Can 257 then is rotated by spindle 39 through the arc D as designated by arrows in FIG. 1. As movement through arc D begins, the cam follower 232 atop rod 199 engages the underside of the downwardly inclined band 290 of cam 289 and as movement through arc D continues cam follower 232 as well as rod 199 and flange head 217 to which it is connected are pushed downwardly. Simultaneously during the downward movement of upper flange head 217, the cam follower wheel 163 beneath lower flange head 151 is moving through lower cam groove 96 which is likewise extending downwardly during arc D so that wheel 163 moves foot 161 and likewise rod 129 downwardly to thus move lower flange head 151 downwardly at a uniform rate and distance with the downward movement of upper flange head 217, so that at no time is can 257 crushed by movement of its gripping flange heads 151 and 217.

At the end of movement through arc D, upper cam follower wheel 232, having been moved downwardly, disengages from cam 289 and it and rod 199 and upper flange head 217 are snapped upwardly by spring 230 to move flange head 217 up and out of engagement with can 257 as shown in FIG. 3, with the stop pin 239 resting against the upper end of notch 237 in collar 192 to stop further upward movement of rod 199. Can 257 is then further moved by clockwise rotation of spindle 39 with upper flange head 217 remaining completely disengaged from can 257 while can 257 remains mounted on lower flange head 151, as depicted in FIG. 3. During movement through arc D, rubber strip 284 mounted to guide bar 280 contacts the exterior intermediate surface of can 257 to press snugly thereagainst. After movement through arc D, the pressure of strip 284 as well as the turret pocket 171 against can 257 holds the can 257 to keep it from wobbling off flange head 151 as the spindle 39 continues to move flange head 151 in a clockwise direction towards turret 295. During the movement of can 257 from the end of arc D toward the turret 295, the cam follower 163 moves lower flange head 151 downward slightly while the can 257 is held in the same position by the friction engagement of rubber strip 287 and turret pocket 171 so that the can is moved to have its lower end slide on top of the rotating turret plate 311 of turret 295, with turret 295 rotating so that the can 257 is positioned within one of the turret recesses 342 and moved counterclockwise by turret 295 until it contacts outlet guide rail 366, at which point guide rail 366 and turret 295 guide the can 257 on to conveyor belt 348. As turret 295 continues to rotate, plate 311 of turret 295 disengages from the underside of can 257 and the can 257 moves on conveyor belt 348 on to a designated location.

The flanging operation is such that the can ends 255 are formed so that they can be turned over on themselves into a J configuration in which they lap over a U shaped end of a can top or bottom 370 in the fashion depicted in FIG. 6.

The flange heads 151 and 217 which had been engaging the can 257 that was removed by outlet turret 295 are rotated by spindle 39 in a clockwise position towards the inlet turret 293 where they are again positioned adjacent turret 293 to receive another can 257 and travel about spindle 39 to carry the new can 257 through the same flanging process, so that a continuous, quick and efficient flanging process can be performed on a plurality of cans.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

What is claimed is:

1. In a flanging machine for flanging the ends of cans such as fiberboard cans, the combination of: a base, a can support on the base, means on the base for making a preliminary flange on at least one end of the can and mechanism for compressing a material of said preliminary flange, said last named mechanism comprising means for rotatably mounting the can support on the base, means for translating the can on the can support in a fixed path, a fixed compression rail adjacent said path and opposite the preliminary flange, the compression rail having means thereon to engage the said preliminary flange portion of the can as the can is translated along its path, said means compressing the material of the can, the can being adapted to roll against the rail and thereby compress the entire circumference of the can.

2. The device of claim 1 further comprising a second fixed compression rail, and wherein the flange head pair moving means has means to compress the sidewall adjacent the other flange head rim against the second compression rail to thereby flange both ends of the can.

3. The device of claim 2 wherein the two compression rails are aligned so that both can ends are simultaneously compressed and flanged.

4. In the machine of claim 1 wherein the compression rail has a nose for contacting the can adjacent the preliminary flange thereon, the nose being rounded and each flange head being correspondingly rounded so that the end of the can is compressed and flanged additionally between the nose and the tapered head.

5. The device of claim 4 wherein the means to move the flange heads with respect to each other comprises a cam follower mounted to one flange head of each pair, to move one head, with means to hold the other head against displacement away from the said one head during such movement.

6. In the machine of claim 5, wherein the means to move the second flange head is adapted to enable the second flange head to move toward the first one but not to move away from it during the aforesaid movement and wherein there is a yieldable means to urge it against movement toward the first one, and a second cam mechanism to move the second flange head toward the first one agaist said yieldable means and then to release it so that the yieldable means can return it to its initial position.

7. The device of claim 4 wherein each compression rail has a nose for contacting the can, each nose being rounded and each flange head rim being similarly rounded to form a matching surface to press the can sidewall therebetween.

8. The device of claim 7 wherein the cans are made of fiberboard.

9. A flanging apparatus for flanging ends of fiberboard cans, comprising:

an upper platform and a lower platform;

a plurality of lower flange heads rotatably mounted to the lower platform, and moveable vertically relative thereto, and means to move each with translating movement of the lower platform;

a plurality of upper flange heads rotatably mounted to the platform, and moveable vertically relative thereto, and means to move each with translating movement of the upper platform, with the upper flange heads being spaced on the upper platform to be axially aligned with the lower flange heads so that a can may be held between the flange heads when the flange heads are separated by a predetermined distance;

the upper flange head having an exterior rim of approximately the same diameter as that of the can interior that tapers from the bottom thereof in an upward and outward direction, so that said first upper tapered surface can seat against the edge of a can, and the lower flange head having a lower exterior rim that is approximately the diameter of the can, and that tapers from the top thereof in a downward and outward direction, so that said second tapered surface can seat against and flange the edge of a can;

means for moving the lower flange head from a first position to a position in which the tapered surface of the lower flange head engages the lower end of a can and moves the can so that the upper can end is engaged to the tapered surface of the upper flange head;

an upper and a lower compression rail mounted in fixed positions relative to the flange heads, the lower compression rail positioned to be at a level and having means to compress the lower end of a can against the tapered surface of the lower flange head when the lower flange head is moved thereagainst, and the upper compression rail positioned to be at a level and having means to compress the upper end of a can against the tapered surface of the upper flange head when the upper flange head is moved thereagainst;

means for translating the lower and upper flange heads and a can held therebetween towards the compression rails so that the lower and upper rails engage against the lower and upper can ends respectively to compress the can ends against the tapered surfaces of the lower and upper flange heads respectively, with the frictional engagement between the flange heads and the can ends created by such compression causing the flange heads to rotate relative to the respective platform upon which they are mounted while the can is being compressed;

means for moving the two heads downwardly after the can flanging has been performed;

means for moving the upper flange head upwardly relative to an engaged can to disengage the can after the can has had its ends flanged; and means to move the lower flange head downwardly relative to an engaged can to disengage the can after the can has had its ends flanged.

10. The structure of claim 9 further comprising a means to engage a portion of the can located closer to the spindle, and means to engage an outer portion of a can at a position when the upper flange head is disengaged from the can.

11. The structure of claim 10 wherein the means to engage the outer portion of the can is a bar having a resilient surface to engage the can.

12. The structure of claim 9 wherein the means for moving the lower flange head into and out of engagement with the end of a can comprises a cam mounted in fixed relation to the lower platform, and a lower cam follower associated with the lower flange head and engaged to said cam to move relative thereto.

13. The structure of claim 9 wherein the means for moving the upper flange head out of engagement with the can comprises a cam follower associated with the upper flange head and a cam mounted in fixed position relative to the upper platform, and means to move the upper flange backward upon release from the cam.

14. The structure of claim 13 further comprising means to limit the range of upward and downward movement of the upper flange head relative to the upper platform.

15. The structure of claim 14 wherein said means to limit movement comprises a tube for mounting a rod to which the upper flange head is attached, said tube having a notch, and said rod having a stop pin mounted thereto to slide within said notch to abut the upper and lower ends thereof to limit movement of said rod to said tube.

16. A flanging apparatus for flanging ends of fiberboard cans, comprising:

a base a spindle on the base having an upper disc and a lower disc attached thereto to rotate with the spindle;

a plurality of lower flange heads mounted on the base and attached to rods and to slide vertically relative to the lower disc, the flange heads being rotatably mounted to the rods to spin relative thereto;

a plurality of upper flange heads mounted on rods which are slidingly attached to tubes mounted to the upper disc, the upper flange heads being rotatably mounted to the upper rods to spin relative thereto, the upper flange heads and the lower flange heads being positioned on their respective discs to be axially aligned with each other so that a can may be held between the flange heads when the flange heads are separated by a pre-determined distance;

the upper flange head having an exterior rim that tapers from the bottom thereof into an upward and outward direction and of a diameter to be inserted into the bottom of the can and to extend outwardly to a diameter greater than that of the can, the portion of the taper closest to the exterior of the upper flange head curving concavely; and the lower flange head having an exterior rim that tapers from the top thereof in a downward and outward direction and of a diameter to be inserted into the bottom of the can and to extend outwardly to a diameter greater than that of the can with the portion of the taper near the exterior of the lower flange head curving concavely; so that the tapered surfaces of the upper and lower flange heads can both receive the upper and lower ends of a can respectively;

means for moving the lower flange head from a first position to a second position in which the tapered surface of the lower flange head engages the lower end of the can and moves the can upwardly so that the upper can end engages the tapered surface of the upper flange head, said means comprising a cam follower mounted to the lower flange rod and a ring cam mounted to extend about the spindle, said cam having an exterior groove which rises and falls as it moves about the cam which groove receives the lower cam follower;

upper and lower arcuate shaped compression rails mounted in fixed position relative to the spindle, each rail having a rounded edge for flanging cans, the lower and upper compression rails positioned at levels to be aligned with the movement of the tapered surfaces of the lower and upper flange heads along predetermined tracks;

means to adjust the position of the upper and lower rails relative to their respective tracks;

means for moving a can held by the upper and lower flange heads towards the compression rails so that the rounded edges of the rails engage against the can ends to compress the can ends against the tapered surfaces of the flange heads, with the frictional engagement between the flange heads and the can ends caused by such compression forcing the flange heads to rotate relative to the flange head rods on which they are mounted so that the can may be rotated 360° to form a completed flange about the full ends of the can;

means for moving the upper and lower flange heads holding a can downward at a uniform rate after the can has been flanged, comprising a cam follower mounted on the upper rod for the upper flange head and a cam mounted above the upper flange head in a stationary position relative to the spindle with interaction between the upper cam follower and the upper cam moving the upper flange head downward, and further comprising the ring cam and lower cam follower moving the lower flange head downward;

means for moving the upper flange head upwardly relative to an engaged can after the can has had its ends flanged and after the upper flange head has been lowered, to disengage the upper flange head from the can, comprising the releasing action of the upper rod cam follower from the upper cam; and means to move the lower flange head downwardly relative to an engaged can that has had its end flanged after the upper flange head has been disengaged from the upper can end, so that the lower can end is disengaged from the lower flange head.

17. A flanging apparatus for flanging the ends of cans comprising: a base; at least one pair of flange heads on said base mounted in aligned opposition to each other, each of said flange heads being approximately the size of the end of the can to be flanged, means to move at least one of said flange heads toward the other to capture a can therebetween, at least one of the flange heads having a tapered rim of a size at its smaller end to fit within the interior of the can and at its larger end to be larger than the interior of the can whereby it acts to impose a preliminary flange upon the can as the flange heads are moved together; means rotatably mounting said flange heads on said base; a fixed compression rail; means to translate the flange heads on the base along said fixed compression rail, means to move the flange head pair to bring the side wall of the can adjacent one of the flange head rims into contact with the compression rail and to compress the circumference thereof between the rim and the compression rail, the flange heads rotating as the can rolls against the compression rail and as the flange head pair is moved to thereby flange the can.

18. A flanging apparatus for flanging the ends of cans comprising: a base; at least one pair of flange heads mounted in aligned opposition to each other; translating means to move the flange heads together on the base in a direction transversely to the alignment of the two flange heads; means on the base to move at least one of the flange heads toward the other to capture a can therebetween, each flange head having a tapered rim which fits within the interior of the can, the smaller end of the said tapered portion being within the can and the larger portion being larger than the inside diameter of the can, whereby when the one flange head is moved toward the other, the tapered rims may engage within the can ends and as the movement of the movable flange head continues, the tapered rims may compress that flange portion on each end of the can, means rotatably mounting said flange heads on said base to rotate about the axis of alignment between them, a fixed compression rail, the translating means to move the flange head pairs together being adapted to bring the side wall of the can adjacent at least one of the flange head rims into contact with the compression rail and compress the circumference thereof between the rim and the compression rail, the flange heads rotating as the can rolls against the compression rail to thereby flange the can around the top of the same.

19. In a method for flanging cans such as fiberboard cans in a flanging machine, the steps of introducing a can blank into the machine and forming on at least one end thereof a preliminary flange, translating the can in a fixed path and rotating it about its center axis, causing the preliminary flange of the can to contact an elongated strip means during said translation and thereby compressing the can at said preliminary flange while rotating the can about its own axis to thereby form said compressed area of the flange completely around the can and then withdrawing the flanged can from the machine.

20. In the method of claim 19 wherein the forming of the preliminary flange is done by engaging the can blank between two tapered heads that are at their smaller ends of a size to fit within the can and at their larger ends are larger than the interior of the can and moving the two heads together to cause the tapered portions to spread the ends of the cans thereby forming the preliminary flanges.

21. In the method of claim 19 wherein the contacts of the can with the strip means takes place with the strip means opposite the preliminary flange and the compression is such as to compress the material of the can to thin it and change its shape to a rounded section.

* * * * *